US010480823B2

(12) United States Patent
Noman et al.

(10) Patent No.: US 10,480,823 B2
(45) Date of Patent: Nov. 19, 2019

(54) MULTI-BURNER HEAD ASSEMBLY

(71) Applicant: Lennox Industries Inc., Richardson, TX (US)

(72) Inventors: Shiblee Noman, Tulsa, OK (US); Ian Burmania, Rockwall, TX (US)

(73) Assignee: Lennox Industries Inc., Richardson, TX (US)

( * ) Notice: Subject to any disclaimer, the term of this patent is extended or adjusted under 35 U.S.C. 154(b) by 834 days.

(21) Appl. No.: 14/079,826

(22) Filed: Nov. 14, 2013

(65) Prior Publication Data

US 2015/0128926 A1 May 14, 2015

(51) Int. Cl.

| | |
|---|---|
| ***F23D 14/04*** | (2006.01) |
| ***F24H 9/18*** | (2006.01) |
| ***F24D 5/02*** | (2006.01) |
| ***F24H 3/06*** | (2006.01) |
| ***F27D 99/00*** | (2010.01) |

(52) U.S. Cl.

CPC ..... *F24H 9/1881* (2013.01); *F23D 14/04* (2013.01); *F24D 5/02* (2013.01); *F24H 3/065* (2013.01); *F27D 99/0033* (2013.01)

(58) Field of Classification Search

CPC ..... F23D 14/08; F23D 14/10; F23D 14/58; F23D 23/00; F23D 2900/00017; F23D 14/04; F24H 3/065; F24H 3/087; F24C 5/06

See application file for complete search history.

(56) References Cited

U.S. PATENT DOCUMENTS

| | | | | | |
|---|---|---|---|---|---|
| 1,536,013 | A | * | 4/1925 | Warner | F23D 14/00 431/13 |
| 1,536,590 | A | * | 5/1925 | Kielberg | F23D 14/10 431/180 |
| 1,604,783 | A | * | 10/1926 | Pickup | F23D 14/04 239/552 |
| 1,637,772 | A | * | 8/1927 | Heckel | F23D 14/36 431/162 |
| 1,644,610 | A | * | 10/1927 | Reichhelm | F23D 11/24 431/175 |
| 1,660,018 | A | * | 2/1928 | Adolf | F23D 14/10 239/419.5 |
| 1,687,983 | A | * | 10/1928 | Klees | F24D 5/00 126/113 |

(Continued)

FOREIGN PATENT DOCUMENTS

| | | | | | |
|---|---|---|---|---|---|
| GB | 1293037 | A | * | 10/1972 | F23N 5/123 |
| GB | 1325436 | A | * | 8/1973 | A47J 37/06 |

(Continued)

OTHER PUBLICATIONS

KR 2010005379 U—English machine translation.*

(Continued)

*Primary Examiner* — Jorge A Pereiro

(74) *Attorney, Agent, or Firm* — Hubbard Johnston, PLLC

(57) ABSTRACT

In various implementations, a multi-burner head assembly may include a venturi inlet coupled to burner heads. The multi-burner head assembly may allow control of the flame profile generated by the assembly. For example, burner heads of the multi-burner head assembly may include different characteristics, such as height.

8 Claims, 4 Drawing Sheets

(56) References Cited

U.S. PATENT DOCUMENTS 1,863,100 A * 6/1932 Coleman ..... F23D 14/045 239/407
2,321,169 A 6/1943 Tullis
2,365,102 A * 12/1944 Olds ..... 236/DIG. 12
2,567,013 A * 9/1951 Feinberg ..... F23D 14/04 431/177
2,711,775 A * 6/1955 Batchelor ..... F16D 69/0416 156/714
2,807,320 A * 9/1957 Wildermann ..... F23D 14/10 239/407
3,113,565 A * 12/1963 Blumenshine ..... F24H 9/1881 126/116 R
3,135,314 A * 6/1964 Brunner ..... F22G 5/02 110/189
3,258,058 A * 6/1966 Herault ..... F23C 99/00 431/329
3,561,900 A * 2/1971 Walbridge ..... F23Q 3/00 361/256
3,837,789 A * 9/1974 Schindler ..... F23D 14/58 239/553
3,926,173 A * 12/1975 Jury ..... F24H 3/087 126/110 R
4,033,320 A * 7/1977 Jury ..... F24H 3/087 126/110 R
4,138,209 A * 2/1979 Bahr ..... G01N 23/2202 164/157
4,174,201 A * 11/1979 Straitz, III ..... F23G 7/08 431/174
5,215,457 A * 6/1993 Sebastiani ..... F23D 14/105 431/326
5,318,438 A * 6/1994 Sugahara ..... F23D 14/045 126/92 R
5,649,820 A * 7/1997 Keller ..... F23G 7/085 239/565
6,179,212 B1 * 1/2001 Banko ..... F23N 1/005 165/261
6,410,896 B2 6/2002 Witonsky et al.
7,003,958 B2 * 2/2006 Dinu ..... F23R 3/286 60/39.822
7,360,534 B2 * 4/2008 Krupp ..... B05B 15/1222 126/110 A
7,494,337 B2 * 2/2009 Specht ..... F23D 14/04 126/116 A
7,631,499 B2 * 12/2009 Bland ..... F23C 6/047 431/278
7,654,819 B2 * 2/2010 Okada ..... F23C 3/002 431/173
8,011,360 B2 * 9/2011 Desi-Seulean ..... F24H 3/087 110/302
8,376,733 B2 * 2/2013 Desi-Seulean ..... F24H 3/087 110/302
9,188,335 B2 * 11/2015 Uhm ..... F23L 7/005
2005/0229921 A1 * 10/2005 Krupp ..... B05B 15/1222 126/298
2005/0239006 A1 * 10/2005 Specht ..... F23D 14/04 431/12
2008/0184991 A1 * 8/2008 Krupp ..... B05B 15/1222 126/99 R
2009/0050291 A1 * 2/2009 Desi-Seulean ..... F24H 3/087 165/47
2009/0061369 A1 * 3/2009 Wang ..... F23M 20/005 431/114
2010/0159410 A1 * 6/2010 Hwang ..... F23D 14/02 431/354
2011/0146652 A1 * 6/2011 Kovacs ..... F24H 3/0488 126/116 R
2012/0003596 A1 * 1/2012 Desi-Seulean ..... F24H 3/087 431/354
2012/0006519 A1 * 1/2012 Desi-Seulean ..... F24H 3/087 165/170
2012/0180487 A1 * 7/2012 Uhm ..... F23D 14/62 60/737
2012/0216792 A1 * 8/2012 Noman ..... F24C 3/006 126/503
2013/0288187 A1 * 10/2013 Imgrundt ..... F23D 14/26 431/258
2014/0065564 A1 * 3/2014 Staley ..... F23D 14/28 432/88
2014/0113240 A1 * 4/2014 Stocker ..... F23D 21/005 432/20
2014/0165991 A1 * 6/2014 Noman ..... F24H 9/0068 126/116 A
2014/0318135 A1 * 10/2014 Knapp ..... F23R 3/14 60/737

FOREIGN PATENT DOCUMENTS

JP 11304113 A * 11/1999
KR 2010005379 U * 5/2010
NL 6410896 3/1966

OTHER PUBLICATIONS

JP 11304113 A—English machine translation.*
International Search Report and Written Opinion received in Patent Cooperation Treaty Application No. PCT/ US2014/065225 dated Jan. 22, 2015, 8 pages.

* cited by examiner

MULTI-BURNER HEAD ASSEMBLY

TECHNICAL FIELD

The present disclosure relates to a multi-burner head assembly.

BACKGROUND

Burners are used with heat exchangers, such as gas furnaces. For example, a flammable fluid, such as natural gas, may be fed into a burner that supplies heat to a heat exchanger.

FIG. 1 illustrates a prior art device 100 for providing heat to a heat exchanger. The device 100 is a uniform burner head design with fixed burner head heights. As illustrated, each burner 110, of the device 100, may include a single venturi inlet 120 coupled to an end of a body 130. The other end of the body 130 is coupled to a single burner head 140. Several burners 110 may be included in the device 100. The burners 110 are uniformly sized and spaced. For example, the burner 100 may be formed by creating uniform openings (e.g., by stamping) in a body. The uniform openings may be the burner heads and the height of the burner head is flush with the outer surface of the body of the burner.

Flames 150 are produced by the burners 110. The flame produced by each burner head of each burner may receive different amounts of air proximate the burner heads, which affects the temperature, size, and/or shape of the flames produced. Thus, some flames may be the result of fuel/air ratios that are too high or too low. This may cause performance issues (e.g., incomplete burn and/or increased operation costs) and/or increase the risk for flashback. This configuration of the device 100 may also require a flashback arrestor or other device to prevent flashback due to different flame profiles generated by each of the burners.

SUMMARY

In various implementations, a multi-burner head assembly may include a venturi inlet coupled to more than one burner head. The multi-burner head assembly may allow control and/or adjustment of the flame profile generated by the assembly (e.g., by altering the burner head characteristics). The multi-burner head assembly may be utilized in applications, such as a furnace.

In various implementations, a multi-burner head assembly may include a venturi inlet and burner heads. The venturi inlet may be coupled to more than one burner head. The burner heads may include a first burner head with a first height and a second burner head with a second height greater than the first height.

Implementations may include one or more of the following features. The multi-burner head assembly may include more than two burner heads. In some implementations, each of the burner heads may have a different height. At least two of the burner heads may be approximately the same height, in some implementations. At least two of the burner heads may have approximately the same width. The multi-burner head assembly may include burner heads in which at least two of the burner heads are different widths.

In various implementations, a multi-burner head assembly may include a venturi inlet coupled to a plurality of burner heads. At least two of the plurality of burner heads may include at least one different burner head characteristic.

Implementations may include one or more of the following features. Burner head characteristics may include burner height, burner width, burner length, and/or burner shape. The multi-burner head assembly may include burner heads in which at least two of the burner heads may include similar burner head characteristics. In some implementations, at least two of the burner heads may include a different width. The multi-burner head assembly may include a burner body. The burner body may be coupled proximate a first end to the venturi inlet and coupled proximate a second end to the more than one of the burner heads.

In some implementations, a gas furnace may include a heat exchanger and a multi-burner head assembly. The heat exchanger may include a shell through which air flows, and a tube bundle through which heat is provided to the air flow in the shell. The heat exchanger may include more than one opening, in which each opening may be coupled to an inlet of a tube of the tube bundle. The multi-burner head assembly may include a venturi inlet coupled to more than one burner head. At least two of the burner heads may include different heights. Each burner head may be disposed proximate an opening of the heat exchanger such that heat may be provided by a burner head to a tube of the tube bundle through the opening of the heat exchanger.

Implementations may include one or more of the following features. At least two of the burner heads may include at least two different burner head characteristics. In some implementations, at least two of the burner heads may include at least one similar burner head characteristic. The multi-burner head assembly may include burner heads in which at least two of the burner heads are similar. The multi-burner head assembly may include a burner body. The burner body may be coupled proximate a first end to the venturi inlet and may be coupled proximate a second end to the more than one burner head. The gas furnace may include a blower to generate the air flow through the shell of the heat exchanger. The gas furnace may include one or more predefined clearances. Each predefined clearance may be disposed between a burner head of the multi-burner head assembly and an opening of the heat exchanger. A first predefined clearance may be disposed between a first burner head and a first opening of the heat exchanger, and a second predefined clearance may be disposed between a second burner head and a second opening of the heat exchanger. The first predefined clearance may be approximately the same as the second predefined clearance. In some implementations, the first predefined clearance may be different from the second predefined clearance. The multi-burner head assembly may allow combustion of natural gas.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Burners may allow combustion of fuel in the presence of air. Fuel may include flammable fluids, such as natural gas, heating oil, and/or propane. Burners may be utilized in a variety of applications such as furnaces or other types of boilers.

Figure 2:
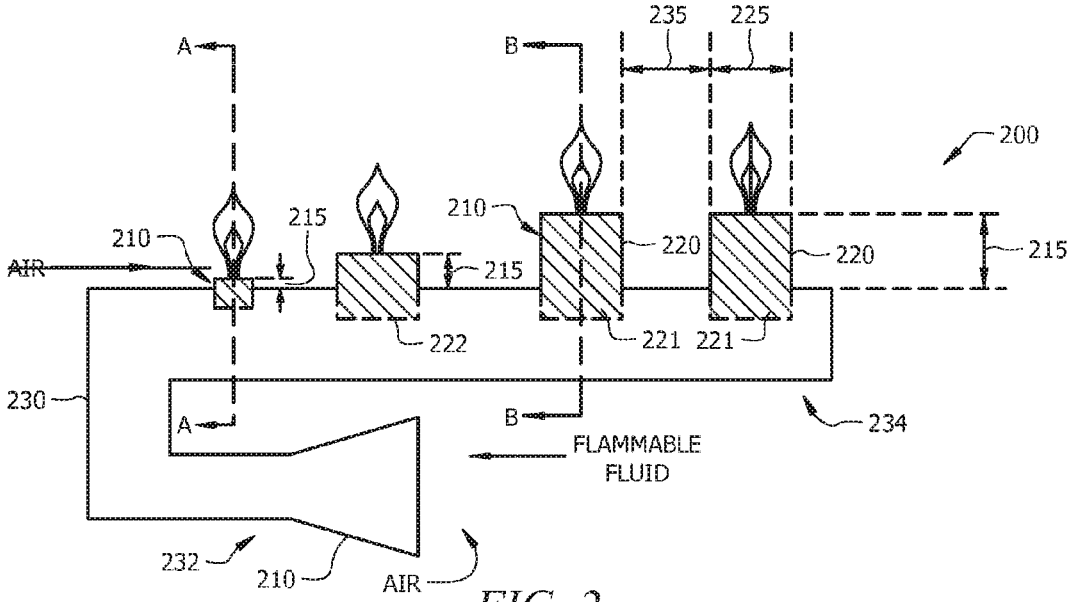
FIG. 2 illustrates a side view an implementation of an example multi-burner head assembly.

In various implementations, a multi-burner head assembly may be utilized. The multi-burner head assembly may allow the flame profile of the flames generated by the multi-burner head assembly to be controlled. FIG. 2 illustrates an implementation of an example multi-burner head assembly 200. The multi-burner head assembly 200 may include metal or other appropriate material (e.g., heat resistant materials).

The multi-burner head assembly 200 includes a venturi inlet 210 coupled to more than one burner head 220. The venturi inlet 210 may be coupled to a body 230. As illustrated, the venturi inlet 210 may be coupled proximate first end 232 of the body 230. The burner heads 220 may be coupled proximate a second end 234 of the body 230. As illustrated, the venturi inlet 210 is coupled to a plurality of burner heads such that fuel may be provided to more than one burner head by the venturi inlet 210.

In some implementations, the size of the venturi inlet 210 may be based at least partially on the use of the multi-burner head assembly 200. The body 230 of the multi-burner head assembly 200 may have a first mixing length. For example, the first mixing length may be selected based on mixing length models. In some implementations, the venturi inlet 210 and the body 230 may be coupled (e.g., fastened, affixed and/or welded). For example, the venturi inlet 210 may be welded to the body.

In various implementations, the multi-burner head assembly 200 may include a plurality of burner heads 220. The burner heads 220 may include one or more characteristics, such as width 225, a length 231 (FIG. 4), a distance 235 between burner heads (e.g., a perpendicular distance between an outer surface of a first burner head and an adjacent outer surface of an adjacent burner head), and/or a height 215 (e.g., a distance above the outer surface of the body that a burner head resides). One or more of the characteristics may affect the flame profile (e.g., temperature, size, and/or height of flame(s)) generated by burner head(s) (e.g., since the characteristic(s) may affect a fuel/air ratio and/or the clearance(s) between burner head(s) and a device, such as a heat exchanger).

In some implementations, the burner heads 220 may be coupled to the body 230 at a height 240 that is fixed. The burner head(s) 220 may be welded or otherwise affixed to the body 230 at a height 215, in some implementations. In some implementations, the burner heads 220 may include a coupling member and the body 230 may include a coupling member adapted to engage with the coupling member of the burner head 220. For example, at least a portion of an outer surface of a burner head may include threads and at least a portion of an inner surface of an opening in the body may include threads adapted to receive the threads of the burner head. In some implementations, at least a portion of the inner surface of the burner head may include threads adapted to engage with threads on at least a portion of the body. Coupling the burner head and the body of the multi-burner head assembly may allow the burner head to be disposed at a fixed predetermined height.

The height 215 of the burner heads 220 may be adjustable, in some implementations. A height of a burner head may be selected and maintained by the burner head. For example, a burner head may include threads that engage with a coupling member of the body. The height of the burner head may be increased or decreased by engaging more or less of the threads of the body. The threads of the burner head engaging with the threads of the coupling member of the body may maintain a selected height of a burner head. In some implementations, the burner head may include protrusion(s) and the body may include one or more levels of recess(es) to receive the protrusion(s). The levels may correspond to different burner head heights. The height of the burner head may be selected by coupling protrusions of the burner head into a level of recess(es).

Figure 3A:
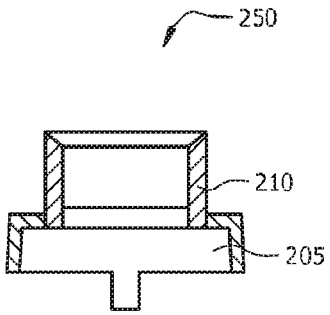
FIG. 3A illustrates a side view of a portion of the implementation of an example multi-burner head assembly, illustrated in FIG. 2.
Figure 3B:
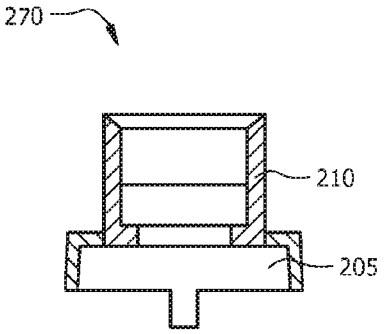
FIG. 3B illustrates a side view of a portion of the implementation of an example multi-burner head assembly, illustrated in FIG. 2.
Figure 4:
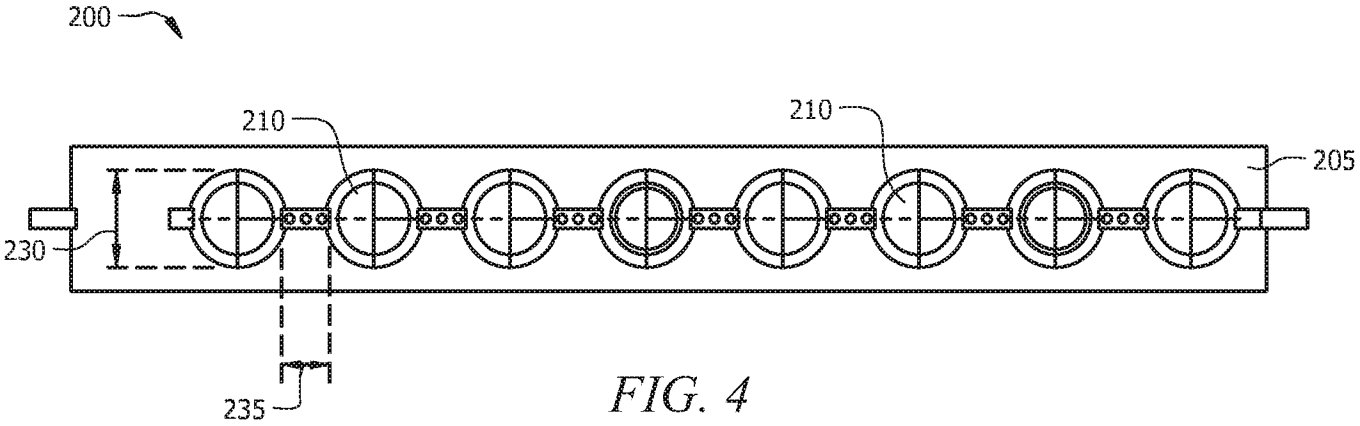
FIG. 4 illustrates a top view of the implementation of an example multi-burner head assembly, illustrated in FIG. 2.

FIG. 2 illustrates side view of an implementation of a portion 200 of an example multi-burner head assembly. FIG. 3A illustrates a cutaway view of an implementation of a portion 250 of the example multi-burner head assembly of FIG. 2 at axis A-A. FIG. 3B illustrates a cutaway view of an implementation of a portion 270 of the example multi-burner head assembly of FIG. 2 at axis B-B. FIG. 4 illustrates a top view of an implementation of the portion 200 of the example multi-burner head assembly, illustrated in FIG. 2. As illustrated, the multi-burner head assembly includes burner heads 210 coupled to a body 205. The burner head 210 may include a height 215 (FIG. 2). The height may be from approximately 0 to approximately 1 inch, in some implementations.

The ratio of fuel/air affect the flame produced by a burner during combustion. The flame profile (e.g., the properties of the flame, such as temperature and/or size) may be determined based on characteristics of the burner head(s), in some implementations. For example, since air is mixed with fuel at the burner head, the fuel/air ratio is affected by characteristics of the burner head such as clearance, height, length, shape, and/or width. For example, a slit or rectangular shaped (e.g., cross-sectional shape) burner head may allow a greater amount of air to be mixed with the fuel at the burner head than a circular shaped (e.g., cross-sectional shape) burner head. A burner head with a first height may mix with less air than a second burner head with a second height that is less than the first height. In some implementations, the distance between burner heads may affect the flame profile since when there is less spacing between burner heads less air may be allowed to mix with fuel at a burner head.

As illustrated, two or more burner heads may include similar and/or different characteristics (e.g. height, width, length, distance between burner heads, and/or cross-sectional area). For example, the height of a first burner 219 may be the same as the height of a second burner 221. The height of at least one burner head may be different from the height of another burner head, in some implementations. For example, the first burner head 219 and a third burner head 222 may have a different heights. In some implementations the width 225 of a burner head 210 may be similar or different.

In some implementations, more than one characteristic (e.g., height, width, length, clearance, and/or distance between burner heads) of two or more burner heads may be similar or different. The width 225 and/or length 231 of one or more of the burner heads 210 may be similar. As illustrated in FIG. 4, the width 225 and the length 231 of the burner heads of a multi-burner head assembly may be similar. In some implementations, two or more burner head may include a similar or different heights, widths, and/or lengths. As illustrated in FIG. 2, the first burner head 219 and the second burner head 221 may include similar heights and widths. The first burner head 219 may have a similar width 225 with as a third burner head 222 but a different height 215. In some implementations, the burner heads may include similar cross-sectional shapes, such as circular, oval, and/or other regular or irregular shapes.

In some implementations, the distance 235 between burner heads 220 may be selected to achieve a flame profile. For example, the distance 235 between burners 220 may be the perpendicular distance residing between an outer surface first burner head and an outer surface of an adjacent second burner head. The distance between burner heads 220 may be selected based on the application of the multi-burner head assembly 200. For example, the placement of the burner heads 220 on a multi-burner head assembly may be based on the placement of the openings in the device of the application (e.g., openings in the furnace).

Figure 1:
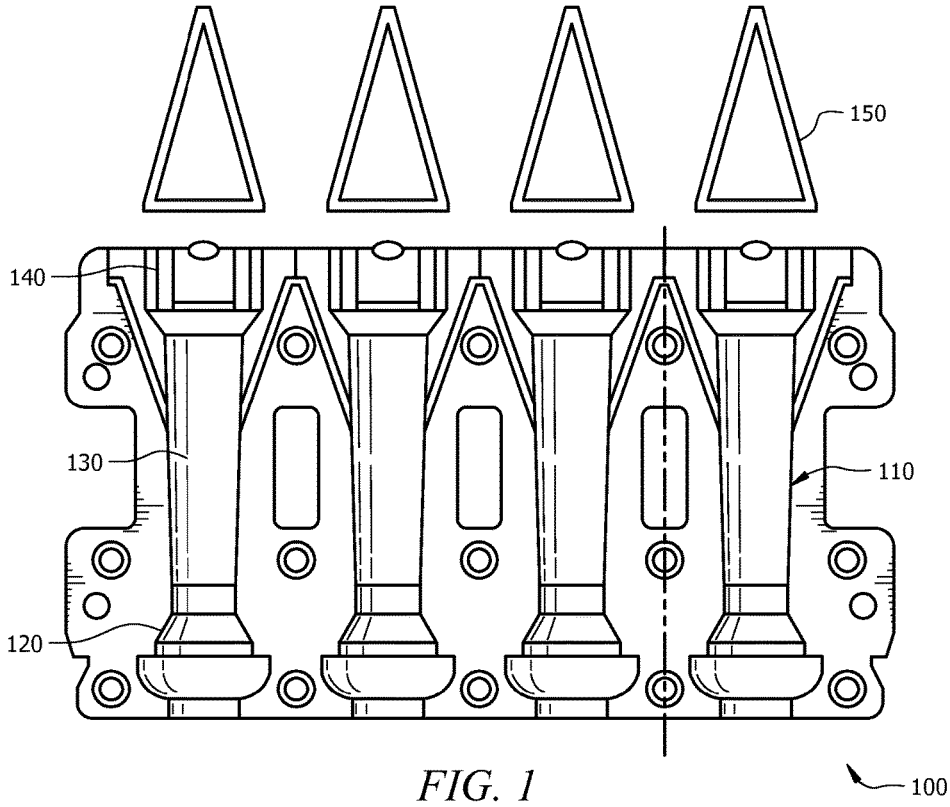
FIG. 1 (prior art) illustrates an example burner.

Thus, in some implementations, by specifying the characteristics of more than one burner head in a multi-burner head assembly 200 (e.g., as opposed to a uniform burner, such as burner 100, illustrated in FIG. 1), control over combustion performance, flame profile (e.g., length, hot spots, and/or fuel/air mixture ratio) may be increased. In some implementations, since a venturi inlet 210 and a body 230 provides fuel and air to more than one burner head 220, the amount of fuel and/or the ratio of fuel/air may not be uniform among the burner heads 220 of the assembly 200. Thus, specifying one or more characteristics of the multi-burner head assembly 200 may allow the flame at a burner head to be controlled. For example, characteristics of one or more of the burner heads (e.g., height, length, width, and/or distance between burners) may be selected such that a predetermined flame profile (e.g., uniform flame profile, flame profile that provides a predetermined amount of heat to a portion proximate a burner head, and/or a predetermined variation in flames across a multi-burner head assembly) may be generated by the combustion of fuel in the multi-burner head assembly. In some implementations, the fabrication tolerance of the distance between burner heads (e.g., such that alignment with the openings in a device, such as a furnace, may be appropriate) may be decreased since the control over the flame profile may be increased (e.g., when compared with a uniform burner, such as burner 100).

Figure 5A:
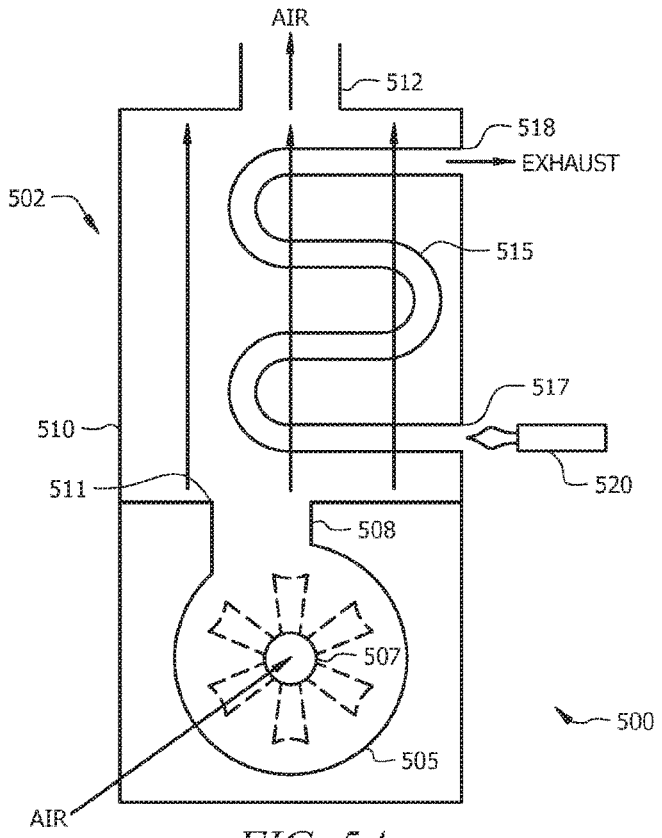
FIG. 5A illustrates an implementation of an example furnace.
Figure 5B:
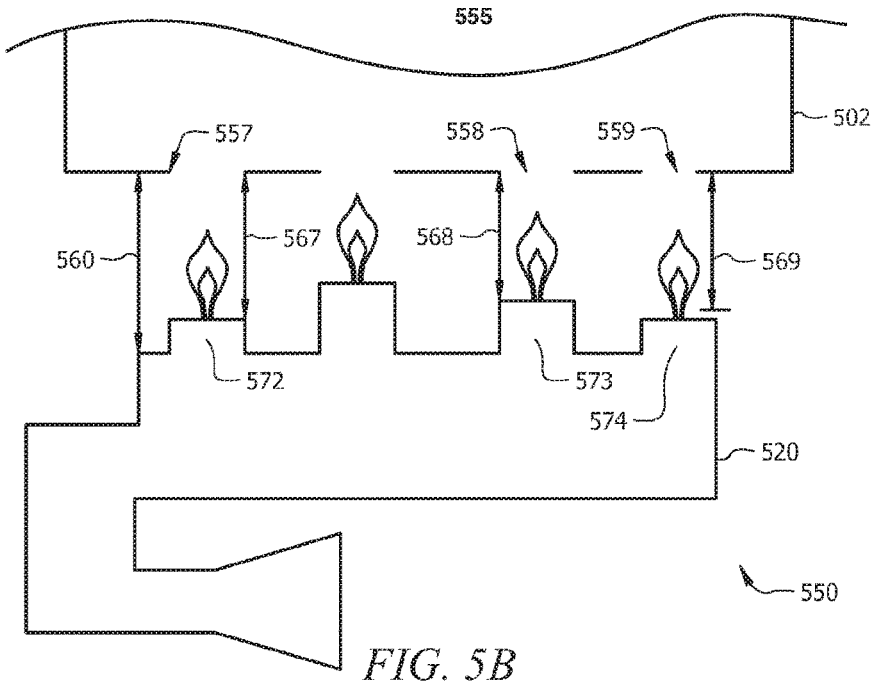
FIG. 5B illustrates an implementation of a portion of an example furnace, illustrated in FIG. 5A.

The multi-burner head assembly may be utilized in a variety of applications, such as a furnace. FIG. 5A illustrates an implementation of an example furnace 500. FIG. 5B illustrates an implementation of a portion 550 of the example furnace 500, illustrated in FIG. 5A. As illustrated, the furnace 500 includes blower 505, a heat exchanger 502 including a shell 510 and tube bundle 515. The furnace 500 may include a multi-burner head assembly 520 to provide heat to air passing through the furnace 500. As illustrated, air is drawn into the furnace via an inlet 507 of the blower 505. The air is provided by the blower 505 through an outlet 508 of the blower to an inlet 511 of the shell 510 of the heat exchanger 502. In the heat exchanger 502, at least a portion of the air contacts at least a portion of the tube bundle 515, which includes one or more tubes. The heat generated by the multi-burner head assembly 520 (e.g., via the combustion of a flammable fluid, such as natural fuel or heating oil) is provided to the tube bundle 515. For example, the multi-burner head assembly 520 may be disposed proximate an opening of the heat exchanger 502, such as an opening 517 of the tube bundle 515. Thus, heat from the tube bundle 515 may be transferred to the air passing by the tube bundle 515. The air with an elevated temperature may leave the heat exchanger 502 via an outlet 512 and be provide to a location, such as a room in a house (e.g., via ducting). The exhaust from the tube bundle 515 may exit the heat exchanger via an outlet 518 of the tube bundle 515.

FIG. 5B illustrates a portion 5A of the implementation of the example furnace 500 illustrated in FIG. 5A. As illustrated, the multi-burner head assembly 520 may be disposed proximate openings 555, 557, 558, 559 of the heat exchanger 502 and/or furnace 500. The multi-burner head assembly 520 may be disposed at a distance 560 from the openings 555 of the heat exchanger 502 and/or furnace 500. A clearance 565, 567, 568, 569 may reside between a burner head (e.g., a top surface of a burner head) 570, 572, 573, 574 and the opening 555, 557, 558, 559 of the heat exchanger 502 and/or furnace 500. The clearance may be a perpendicular distance between a top surface of a burner head and the opening 555, 557, 558, 559 of the furnace 500.

The two or more burners 570, 572, 573, 574 may have approximately the same clearance or different clearances. The clearance may affect the fuel/air ratio since the closer the burner head resides to the opening of the heat exchanger and/or furnace, the less air that is allowed to mix with the fuel at the burner head. For example, a first clearance 567 may exist between a first burner head 572 and a first opening 557 of the heat exchanger 502. A second clearance 568 may exist between a second burner 573 and a second opening 558 of the heat exchanger 502. A third clearance 569 may exist between a third burner head 574 and a third opening 559 of the heat exchanger 502. Likewise, a distance 565 is between burner head 570 and opening 555. The first clearance 567 and the second clearance 568 may be different. The first clearance 567 and the third clearance 569 may be approximately the same.

Allowing characteristics of the burner heads to vary between burners may allow better control of the flame characteristics of a multi-burner head assembly (e.g., when compared with uniform burner designs with fixed heights, as illustrated in FIG. 1). In some implementations, an application such as a furnace may include specifications that include a flame profile (e.g., amount of heat) criteria for a multi-burner head assembly. The characteristics (e.g., height, clearance, and/or width) may be selected to satisfy the flame profile criteria and/or furnace specifications (e.g., opening size, heat output, etc.). For example, the criteria of the flame profile in the specifications may include approximately similar flame properties (e.g., temperature and/or size) for each burner of the multi-burner head assembly. However, since the fuel/air ratio may vary with each head of the burner, even when the burner heads have the same characteristics, the flames produced may be different. Thus, one or more of the characteristics of each burner head may be selected to satisfy the criteria of the flame profile in the specification.

In some implementations, a flame arrestor may not be utilized with the multi-burner head assembly. For example, when a burner with uniform burner height, such as the burner in FIG. 1, is utilized, some burner heads may not have the appropriate fuel/air mixture ratio (e.g., to satisfy flame profile criteria and/or to reduce a risk of flashback). Thus, flashback may occur and a flame arrestor is utilized to minimize the risk of flashback. A multi-burner head assembly may be specified with characteristics to reduce the risk of flashback (e.g. when compared to a burner with uniform burner height). For example, burner heights and/or clearances may be selected such that each burner head in a multi-burner head assembly has a minimum fuel/air mixture ratio (e.g., provided by a user, and/or based a type of furnace, factory specifications, industry standards, and/or government standards). The minimum fuel/air mixture ratio may be specified to reduce the risk of flashback (e.g., when compared to burners with uniform burner heads).

During use, the fuel, which includes a flammable fluid (e.g., natural gas and/or heating oil), may be provided to the venturi inlet of the multi-burner head assembly. Air may be drawn in with the flammable fluid through the opening of the venturi inlet. The velocity and/or amount, for example, of the flammable fluid and/or the properties of the venturi inlet (e.g., size) may affect the fuel/air mixture ratio. The air and flammable fluid may mix along the mixing length of the body of the multi-burner head assembly and be provided to the burner heads. The flammable fluid may combust in a flame proximate the burner head. Air may also be provided to the combustion from the air proximate the burner heads, thus, the clearance may affect the fuel/air mixture ratio. Thus, by adjusting or selecting a burner height for each burner head in a multi-burner head assembly, a flame profile may be selected to satisfy a criteria (e.g., from a user, for an application, to satisfy government and/or industry guidelines, etc.).

Although a furnace has been described in implementations, the multi-burner head assembly may be utilized in other applications, such as other types of boilers. For example, a clearance may exist between an opening of the device of the application, such as a boiler, and a burner head.

In some implementations, the multi-burner head assembly may be provided in a kit. The kit may include components, such as a venturi inlet, a body, and a plurality of burner heads. The burner heads may be uniformly sized. The burner heads may be coupled to openings of the body of the multi-burner head assembly such that different heights may be selected between two or more of the burner heads. For example, a user may screw a burner head in to achieve a first height or partially screw a burner head into an opening to achieve different heights. One or more components may be preassembled in the kit. In some implementations, the body may be segmented such that each segment of the body is coupleable to another segment of the body, the venturi inlet or burner heads. Thus, the mixing length of the multi-burner head assembly may be selected by coupling and/or uncoupling segments as appropriate.

In some implementations, the burner heads may be uniformly sized and the heights of the burner heads may be adjusted by at least partially coupling and/or at least partially decoupling the burner head from an opening in the body. For example, a burner head may be disposed at least partially in a cavity (e.g., where fuel/air flow to the burner head) of the body to select a first height and achieve a first clearance. A burner head may be at least partially decoupled (e.g., by at least partially unscrewing the burner head) to adjust the height of the burner head.

In some implementations, the multi-burner head assembly 200 or portions thereof may be a formed as a single unit. For example, the multi-burner head assembly 200 may be molded into a single unit. The venturi and body of the multi-burner head assembly 200 may be a single unit. In some implementations, the burner heads and the body may be a single unit.

In some implementations, a multi-burner head assembly may be provided for use in a furnace. The multi-burner head assembly may be approximately 13 wide to approximately 14 inches wide. A burner head may be approximately 0.6 to approximately 1.3 inches high. A burner head may be approximately 0.5 to approximately 1 inch in width. The burner head may be approximately 0.5 to approximately 1 inch in length. The burner head opening may be have an approximately circular cross-sectional shape. For example the burner head may be approximately 0.5 inches in diameter. The distance between burner heads may be between 0.2 and 0.3 inches.

Although users have been described as a human, a user may be a person, a group of people, a person or persons interacting with one or more computers, and/or a computer system.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "an burner head" includes a combination of two or more burner heads; and, reference to "an inlet" includes different types and/or combinations of inlets. Reference to "a coupling member" may include a combination of two or more coupling members. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A multi-burner head assembly comprising:

a mixing body operable to mix air and gas;

a venturi inlet coupled to the mixing body and configured to receive air and gas;

a plurality of burner heads coupled to the mixing body and comprising a single row, wherein the burner heads comprise a first burner head comprising a first height and a second burner head comprising a second height different than the first height, and wherein the second burner head is proximate the first burner head, and a third burner head with a third height different than the first and second heights;

wherein a first distance between the first and second burner head is different than a second distance between the second and third burner head;

wherein the first burner head is immediately adjacent to the second burner head and the second burner head is immediately adjacent to third burner head;

wherein the first burner head, second burner head, and third burner head are not coaxial; and wherein the first, second, and third heights and the first and second distances are configured to cause the first, second, and third burner heads to have a similar flame profile.

2. The multi-burner head assembly of claim 1 further comprising more than three burner heads.

3. The multi-burner head assembly of claim 2 wherein each of the burner heads comprises a different height.

4. The multi-burner head assembly of claim 2 wherein at least two of the burner heads are approximately the same height.

5. The multi-burner head assembly of claim 2 wherein at least two of the burner heads are approximately the same width.

6. The multi-burner head assembly of claim 2 wherein at least two of the burner heads comprise openings having different cross-sectional areas.

7. A gas furnace comprising:

a heat exchanger comprising:

a shell through which air flows, and a tube bundle through which heat is provided to the air flow in the shell;

more than one opening, wherein each opening is coupled to an inlet of a tube of the tube bundle;

a multi-burner head assembly comprising;

a mixing body configured to mix gas and air, a venturi inlet coupled to the mixing body, and a plurality of burner heads coupled to the mixing body by a plurality of coupling mechanisms, wherein the plurality of coupling mechanisms allow heights of the plurality of burner heads to be adjusted, wherein the plurality of coupling mechanisms comprise threaded portions on the mixing body and the plurality of burner heads, wherein at least two of the burner heads comprise openings having different cross-sectional areas; and one or more predefined clearances, wherein each predefined clearance is disposed between a burner head of the multi-burner head assembly and an opening of the heat exchanger, and wherein a first predefined clearance disposed between a first burner head and a first opening of the heat exchanger, and wherein a second predefined clearance is disposed between a second burner head and a second opening of the heat exchanger, and wherein the first predefined clearance is approximately the same as the second predefined clearance.

8. A gas furnace comprising:

a heat exchanger comprising:

a shell through which air flows, and a tube bundle through which heat is provided to the air flow in the shell;

more than one opening, wherein each opening is coupled to an inlet of a tube of the tube bundle;

a multi-burner head assembly comprising;

a mixing body configured to mix gas and air, a venturi inlet coupled to the mixing body, and a plurality of burner heads coupled to the mixing body by a plurality of coupling mechanisms, wherein the plurality of coupling mechanisms allow heights of the plurality of burner heads to be adjusted, wherein the plurality of coupling mechanisms comprise threaded portions on the mixing body and the plurality of burner heads, wherein at least two of the burner heads comprise openings having different cross-sectional areas; and one or more predefined clearances, wherein each predefined clearance is disposed between a burner head of the multi-burner head assembly and an opening of the heat exchanger, and wherein a first predefined clearance disposed between a first burner head and a first opening of the heat exchanger, and wherein a second predefined clearance is disposed between a second burner head and a second opening of the heat exchanger, and wherein the first predefined clearance is different from the second predefined clearance.

* * * * *